US005376488A

United States Patent [19]

Ohmura et al.

[11] Patent Number: 5,376,488

[45] Date of Patent: Dec. 27, 1994

[54] CARRIER FOR ELECTROSTATIC IMAGE DEVELOPER AND PROCESS FOR THE PRODUCTION THEREOF

[75] Inventors: Ken Ohmura; Shigenori Kouno; Tomoyasu Umeno, all of Hachioji, Japan

[73] Assignee: Konica Corporation, Tokyo, Japan

[21] Appl. No.: 51,881

[22] Filed: Apr. 26, 1993

[30] Foreign Application Priority Data

Jul. 27, 1992 [JP] Japan ..... 4-218750

[51] Int. Cl.[5] ..... G03G 9/083

[52] U.S. Cl. ..... 430/106.6; 430/108; 430/110; 430/137

[58] Field of Search ..... 430/106.6, 108, 137, 430/110

[56] References Cited

U.S. PATENT DOCUMENTS 5,182,181 1/1993 Koizumi et al. ..... 430/108

5,192,635 3/1993 Inukai et al. ..... 430/108

*Primary Examiner*—Marion E. McCamish

*Assistant Examiner*—Mark A. Chapman

*Attorney, Agent, or Firm*—Finnegan, Henderson Farabow, Garrett & Dunner

[57] ABSTRACT

A carrier of developer for developing an electrostatic image and a method for producing the carrier are disclosed. The carrier comprises core particles each having a resin layer covering the surface of said core particle. The resin layer is formed by dry process in which the core particles are stirred together with fine resin particles with no solvent for the resin to form the resin layer on the surface of each core particle. The fine resin particles comprise a homopolymer or a copolymer comprising a fluorinated acrylate repeating unit and are formed by emulsified polymerization carried out in the presence of a surfactant comprising an alkylbenzene sulfonic compound, and the residual amount of the surfactant in the fine resin particles is within the range of from 60 ppm to 10,000 ppm. The carrier is improved in adhesion between the surface of the core and the resin layer and satisfactory in friction electricity providing capability.

14 Claims, 2 Drawing Sheets

CARRIER FOR ELECTROSTATIC IMAGE DEVELOPER AND PROCESS FOR THE PRODUCTION THEREOF

FIELD OF THE INVENTION

The present invention relates to a carrier of developer for developing an electrostatic image, which is prepared by forming a resin coating layer on the surface of core particles.

BACKGROUND OF THE INVENTION

Two-component developers used in electrophotography comprise a toner and a carrier, and the carrier is used for the purpose of imparting a proper amount of polar frictional electricity to the toner.

As such a carrier, a resin coated carrier having a resin coating layer on the core particle surface is used for various reasons including enhancement of the frictional electricity providing capability.

It is known to skilled persons of the art that a resin coating layer comprising a fluorine-containing resin has favorable properties, and that a fluorinated acrylate polymer is particularly preferred as a material for the coating layer, because (1) this polymer has a glass transition point higher than that of other fluorine-containing resins and, therefore, are less liable to melt and stick to the surface of carriers, and (2) electrification can be easily controlled by varying the number of fluorine atoms contained in the branched chain.

As a resin-coated carrier using such a fluorinated acrylate polymer, Japanese Pat. O.P.I. Pub. No. 235964/1988 discloses an electrostatic image developing carrier prepared by coating the surface of core particles with fine particles of a fluorinated acrylate polymer by use of a dry process.

However, these electrostatic image developing carriers have the problems described below.

(1) Resins comprising fluorinated acrylates are generally poor in adhesion to the core particles and low in film forming property. Accordingly, when used in forming a resin coating layer by a dry process, fine particles of these resins cannot be adhered and extended properly to the surface of core particles, yielding a carrier of poor durability.

(2) Fine resin particles used to form a resin coating layer can be prepared by, for example, emulsion polymerization. According to a study of the present inventors, however, resin fine particles obtained by the usual emulsion polymerization do not always form a satisfactory resin coating layer and often give a carrier poor in capability of providing a toner with an adequate frictional electricity. When such a toner is used, formation of sharp images is prevented and, moreover, troubles such as fogging and scattering of toner are apt to be caused in the process of image formation.

SUMMARY OF THE INVENTION

The first object of the invention is to provide an electrostatic image developing carrier excellent in adhesion between the surface of core particles and a coating layer of resin with high film forming property (extensibility of fine particles) and satisfactory in friction electricity providing capability. The second object of the invention is to provide a method for producing an electrostatic image developing carrier having the abovementioned excellent properties by a simple and sure means.

The present inventors it is found by the inventers that a carrier having a satisfactory adhesion between the surface of core particles and a resin coating layer, an excellent film forming property and an adequate frictional electrification providing capability can be obtained by use of fluorinated alkyl acrylate polymer fine particles prepared by carrying out an emulsion polymerization in the presence of a specific surfactant and by regulating the amount of residual surfactant contained in the fine resin particles within a prescribed range.

The carrier of the invention comprises core particles each having a resin layer covering the surface of said core particle. The resin layer is formed by dry process in which the core particles are stirred together with fine resin particles to form the resin, any solvent for resin is not used at this time. The fine resin particles comprise a homopolymer or a copolymer comprising a fluorinated acrylate repeating unit, which are formed by emulsified polymerization carried out in the presence of a surfactant comprising an alkylbenzene sulfonic compound, and the residual amount of the surfactant in said fine resin particles is within the range of from 60 ppm to 10,000 ppm. It is preferable that the core particles and the fine resin particles are placed in a rotor blade mixer and stirred at a stirring blade peripheral speed of 4 m/sec to 12 m/sec.

Further, it is preferable that the resin coating layer be formed by a dry process using fine resin particles having a primary particle size of 50 to 500 $\mu$m and a BET specific surface area of 10 to 120 $m^2/g$.

Because the fine resin particles used to form the resin coating layer comprise a fluorinated acrylate (co)-polymer obtained by an emulsion polymerization conducted in the presence of a specific surfactant, and the amount of the surfactant retained in the fine resin particles is regulated within a prescribed range, the primary particle size and BET specific surface area of the fine resin particles are each controlled within a range suitable to the formation of the resin coating layer; therefore, the adhesion between the core particle surface and the resin coating layer as well as the film forming property are markedly improved and, moreover, the frictional electricity providing capability is satisfactorily developed, as shown by the results of the examples described later.

Regulating the peripheral speed of stirring blades of the rotor blade mixer (the intensity of stirring) within a prescribed range improves the adhesion between the core particle surface and the resin coating layer and, thereby, allows the foregoing carrier to be produced advantageously.

DETAILED DESCRIPTION OF THE INVENTION

Constituents of the Carrier

Figure 1:
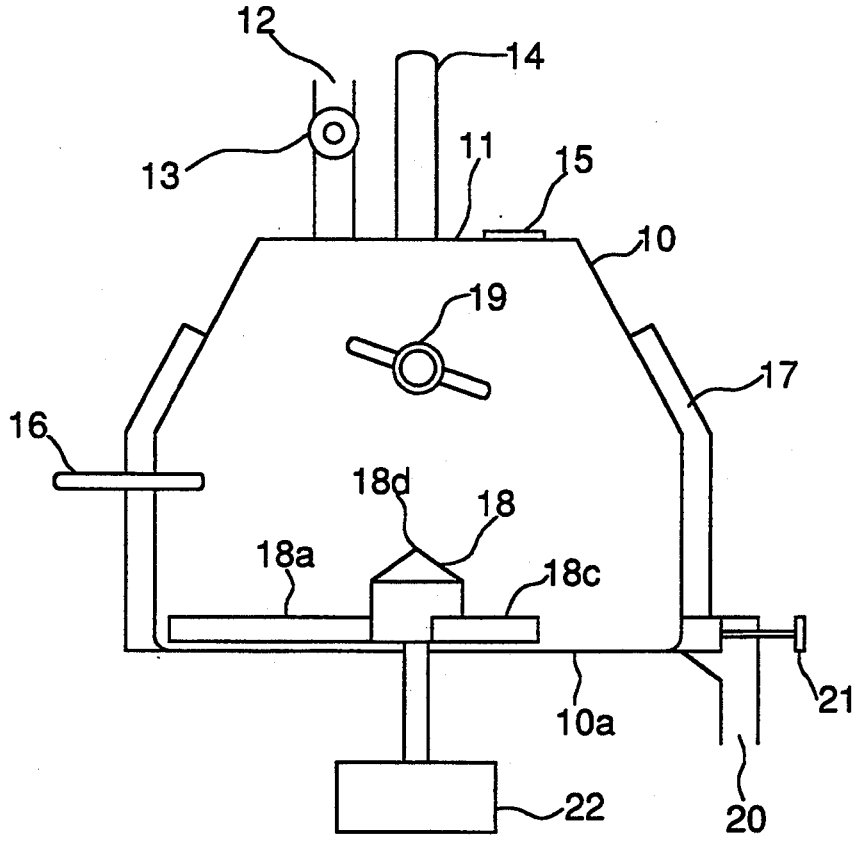
FIG. 1 is a schematic diagram of a horizontal rotor blade mixer suitable for producing a carrier of the invention.

The carrier of the invention is a resin coated carrier comprising a core particle and a resin coating layer formed on the surface of the core particles.

As core particles of the carrier, particles of a magnetic substance are used.

Suitable magnetic substances are those strongly magnetized by a magnetic field in its direction such as iron, ferrite or magnetite. "Ferrite" is a general term for iron-containing magnetic oxides and not limited to spinel type ferrites represented by the chemical formula $MO.Fe_2O_3$, where M represents a divalent metal such as nickel, copper, zinc, manganese, magnesium or lithium.

Taking into account the capability of providing a toner with frictional electricity and the adhesion of a carrier to a photoreceptor, the size of core particles is preferably 20 to 200 μm, more preferably 30 to 120 μm, in weight average particle sizes. The weight average particle size of the carrier is a value determined by a dry process using a Microtrack Type 7981-OX made by Leeds & Northrup Co.

On the other hand, the resin coating layer is formed on the surface of such core particles by a dry process using fine resin particles.

The term "dry process" used here means a process for the formation of the resin coating layer on the core particle surface, without the use of any solvent for the resin, by mixing and stirring core particles and fine resin particles and applying mechanical impact force repeatedly to them. Materials of the Fine Resin Particles The fine resin particles used in the invention comprise a fluorinated acrylate homopolymer or copolymer.

The fluorinated acrylate homopolymer means a polymer comprising a fluorinated acrylate repeating unit alone (hereinafter occasionally referred to as a F—Ac repeating unit), and the fluorinated acrylate copolymer is copolymers comprising the foregoing F—Ac repeating unit and another repeating unit.

The F—Ac repeating unit which forms the fluorinated acrylate polymer or copolymer includes the unit represented by the following formula 1.

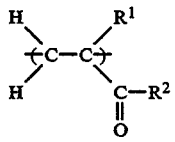

Formula 1 where $R^1$ represents a hydrogen atom or a methyl group, and $R^2$ represents a residue formed by removing a hydrogen atom from the hydroxyl group of an alcohol compound containing an alkyl group in which at least one hydrogen atom is substituted by a fluorine atom.

As residues represented by $R^2$ in the foregoing F—Ac repeating unit of formula 1, preferable are $—O(CH_2)_nC_mF_{2m+1}$ (n: an integer of 1 to 8, m: an integer of 1 to 19) and $—O(CH_2)_p(CF_2)_qH$ (p: an integer of 1 to 8, q: an integer of 1 to 19); particularly preferred are $—OCH_2CF_3$, $—OCH_2(CF_2)_2H$ and $—OCH_2CF_2CF_3$.

The fluorinated acrylate copolymer is composed of the foregoing F—Ac repeating unit and another repeating unit. Such another repeating unit may be a repeating unit derived from a monomer such as an aliphatic olefine, halogenated aliphatic olefine, conjugated diene type aliphatic diolefine, aromatic vinyl compound, nitrogen-containing vinyl compound or alkyl (meth)acrylate, and may be used in combination of two or more types to form the fluorinated acrylate copolymer.

Typical examples of the monomer used to introduce another repeating unit include the monomers illustrated in Japanese Pat. O.P.I. Pub. No. 33562/1989. Among them, styrene, methylstyrene and alkyl (meth)acrylates are particularly preferred from the viewpoint of controlling electrification amount and film forming property.

In the embodiment of the invention, the content of the F—Ac repeating unit in the fluorinated acrylate copolymer is preferably not less than 50 wt %; more preferably, the content is not less than 55 wt %.

When the content of the F—Ac repeating unit is more than 50 wt %, the initial electrification amount of a toner can be usually controlled within the range of 10 to 40 μC/g and is not reduced by repeated uses; accordingly, the durability of the developer is improved and, thereby, sharp developed images can be formed constantly from the beginning to the end of copying.

Preparation of Fine Resin Particles

The first feature of the carrier of the invention is that the fine resin particles are prepared by an emulsion polymerization conducted in the presence of a surfactant containing an alkylbenzene sulfonic acid compound.

By use of an alkylbenzene sulfonic acid compound as surfactant, the primary particle size and BET specific surface area of the fine resin particles can be controlled within the range suitable for the formation of the resin coating layer.

Usable alkylbenzene sulfonic acid compounds include alkylbenzene sulfonates of the following formula (a) and alkylbenzene sulfonates of the following formula (b); preferred among them are alkylbenzene disulfonates.

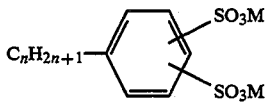

(a)

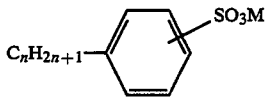

(b)

where M represents an alkali metal or an alkali earth metal atom, preferably a sodium atom or a potassium atom, and n is an integer of 12 to 22, preferably an integer of 15 to 19.

Besides the foregoing alkylbenzene sulfonic acid compounds used as essential surfactants in the invention, other types of surfactants may be jointly employed. Such surfactants are not particularly limited to specific ones and may be selected from conventional ones. However, it is preferred that the amount of the alkylbenzene sulfonic acid compound be not less than 50 wt % of the total amount of the surfactants used in the emulsion polymerization.

Size of Fine Resin Particles

The primary particle size of the fine resin particles is preferably 50 to 500 nm.

The term "primary particle size" used here means the size of fine particles dispersed in the emulsion after completion of the emulsion polymerization.

The BET specific surface area of the fine resin particles is preferably 10 to 120 $m^2/g$. When the BET specific surface area is kept within this range at the time of mixing with core particles, the fine resin particles are easily pulverized into primary particles having a good film forming property, facilitating the formation of a uniform resin coating layer.

The fine resin particles prepared by the emulsion polymerization form aggregates on drying. The size of such aggregates is preferably 1 to 50 μm in view of miscibility with core particles and film forming property.

Residual Amount of Surfactant

The second feature of the carrier of the invention is that the residual amount of the foregoing surfactant in the fine resin particles is regulated within the range of 60 to 10,000 ppm.

As an outcome of study by the inventors, it is found that the objects of the invention cannot be achieved adequately only by use of a surfactant containing an alkylbenzene sulfonic acid compound.

That is, the adhesion between the core particle surface and the resin coating layer as well as the film forming property can be improved and, thereby, an electrostatic image developing carrier having a satisfactory frictional electricity providing capability can be prepared by regulating the residual amount of the surfactant retained in the fine resin particles.

In the invention, the residual amount of the surfactant can be controlled by adjusting the amount of the surfactant used in the emulsion polymerization and the washing conditions of the fine resin particles.

Formation of Resin Coating Layer

The resin coating layer constituting the carrier of the invention is formed by a dry process which uses the foregoing fine resin particles.

In a preferred example of the dry process, core particles and fine resin particles are uniformly mixed, for example, in a conventional mixer, the mixture is placed, for example, in a modified apparatus of conventional rotor blade mixer and, then, mechanical impact force is repeatedly applied to the mixer for 5 to 40 minutes to form a resin coating layer on the core particle surface.

In a particularly preferred example, this mixture is stirred for 5 to 15 minutes at room temperature and then stirred further within a temperature range of (Tg−15)° C. to (Tg+15)° C. to form a resin coating layer, where Tg is a glass transition point of the fine resin particles contained in the mixture.

In order to give a proper resistivity to the carrier, the amount of the fine resin particles to be blended is controlled within the range of preferably 0.3 to 10 wt %, more preferably 0.5 to 5 wt % of the core particles.

FIG. 1 illustrates an example of the horizontal rotor blade mixer suitable for the production of the carrier of the invention, in which stock feed opening 12 equipped with feeding valve 13, and filter 14 and check opening 15 are provided on top lid 11 of mixing chamber 10.

Figure 2:
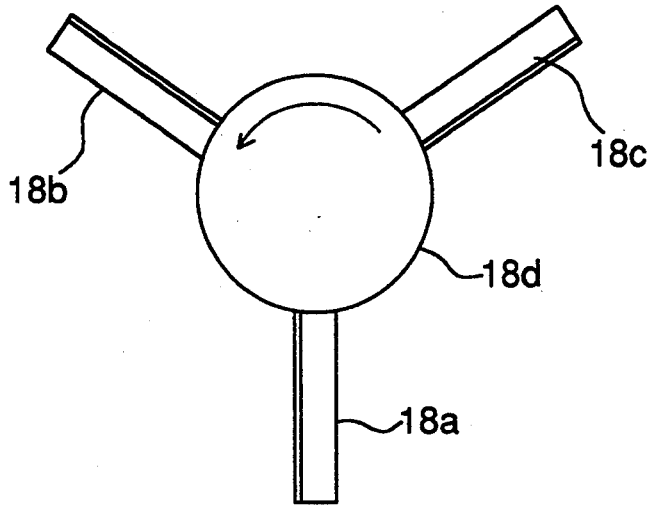
FIG. 2 is a plan view of the horizontal rotor blade mixer.
Figure 3:
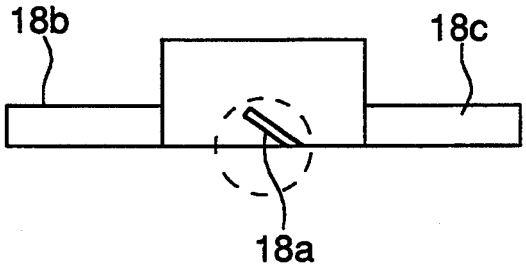
FIG. 3 is a front view of the horizontal rotor blade mixer.
Figure 4:
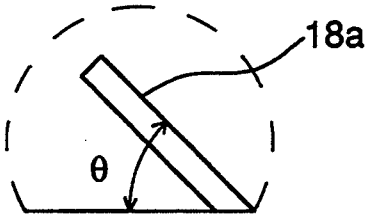
FIG. 4 is an enlarged front view of the horizontal rotor blade mixer.

A carrier stock introduced from stock feed opening 12 via feeding valve 13 is stirred by rotor blades 18*a*, 18*b* and 18*c* of horizontal rotator 18 driven by motor 22 and, thereby, subjected to mechanical impact force. As shown in FIG. 2, horizontal rotator 18 comprises center piece 18*d* which rotates in the arrow direction, and three rotor blades 18*a*, 18*b* and 18*c* provided symmetrically with respect to center piece 18*d*. These rotor blades each have inclined planes running upwards obliquely at an angle of θ° from bottom 10*a* of mixing chamber 10, as shown in FIGS. 3 and 4. Accordingly, a carrier stock introduced is driven upwards by these rotor blades. The driven carrier stock strikes against the inclined upper inner wall or the vertical lower inner wall of mixing chamber 10 and falls into the rotating area of rotor blades 18*a*, 18*b* and 18*c* of horizontal rotator 18. In mixing chamber 10, vertical rotator 19 is provided above horizontal rotator 18. This vertical rotator 19 has two rotor blades, which strike the carrier stock having rebounded from the inner walls of mixing chamber 10 while rotating vertically. This vertical rotator 19 performs the functions of accelerating stirring of the carrier stock and preventing aggregation thereof.

As described above, the carrier stock is subjected to mechanical impact force while colliding repeatedly with horizontal rotator 18, vertical rotator 19 and the inner walls of mixing chamber 10 or collisions among carrier stock particles, so that the fine resin particles are caught, spread and fixed on the core particles to form a resin coating layer. The resin coated carrier so prepared is taken out from product discharge opening 20 with the aid of discharge valve 21.

Jacket 17 functions as a heating means at the time of stirring the carrier stock and as a cooling means after completion of the stirring. The outer wall of mixing chamber 10 is covered with jacket 17 up to about ¾ of its height, or the height at which vertical rotator 19 is mounted. The temperature of a carrier stock is measured with thermometer 16.

Vertical rotator 19 is not necessarily indispensable and used when occasion demands; therefore, there may be provided horizontal rotator 18 alone.

Peripheral Speed of the Rotor Blades

The feature of the production process of carriers according to the invention is that a resin coating layer is formed by the steps of introducing core particles and fine resin particles into such a rotor blade mixer as described above and stirring them at a stirring intensity which gives rotor blade peripheral speed of 4 to 12 m/sec, preferably 6 to 10 m/sec.

Regulating the peripheral speed of rotor blades in a rotor blade mixer (stirring intensity) within a prescribed range improves the adhesion between core particles and resin coating layers and, thereby, makes it possible to prepare the carrier of the invention advantageously.

The carrier of the invention is made up into a two-component developer by being mixed with a toner. A mixing ratio of giving a toner content of 1 to 10 wt % is preferred. Since toner types are not particularly limited, conventional toners can be used.

EXAMPLES

Examples of the invention are described hereunder together with comparative examples. Parts in the following description are parts by weight.

Preparation of Fine Resin Particles

Fine Resin Particle A 1,1,1-trifluoroethyl methacrylate was emulsion polymerized in the presence of a surfactant comprising a sodium alkylbenzene sulfonate of the following formula 1. Then, the resultant fluorinated methacrylate polymer was separated from the polymerization medium by ultrafiltration, washed and spray dried to obtain resin fine particle A.

The primary particle size, BET specific surface area and residual amount of surfactant of fine resin particle A were measured by the following methods:

Primary Particle Size

Using the emulsion immediately after the emulsion polymerization, measurement was made with an LPA-3000 particle size distribution measuring equipment made by Otsuka Denshi Co.

BET Specific Surface Area

Measurement was made with a FlowSorb II-2300 BET specific surface area measuring equipment made by Shimadzu Corp.

Residual Amount of Surfactant

Fine resin particle A was accurately weighed out and dissolved in methyl ethyl ketone, followed by addition of methanol to precipitate the resin component. Then, the supernatant was filtered. The filtrate was condensed and analyzed for the surfactant by high performance liquid chromatography under the following conditions:

Column: TSK-GEL LS-410 ODS 5 μm

Detector: Differential refractometer

Eluate: acetonitrile—0.05 mol/1 NaCl solution (50/50)

Flow velocity: 1.5 ml/min

The evaluation results are shown in Table 1.

Fine Resin Particles B to D, Fine Resin Particles e to j

Inventive fine resin particles B to D and comparative fine resin particles e to j were prepared in the same manner as fine resin particle A except that the surfactants shown in Table 1 were used in place of compound formula 1. The resultant fine resin particles were each measured for the primary particle size, BET specific surface area and residual amount of the surfactant as shown in Table 1.

For fine resin particles e and f, the residual amount of the surfactant was adjusted by varying the amount of surfactant used in the emulsion polymerization and the number of washing times.

For fine resin particles g to j, the residual amount of the surfactant was measured by properly selecting a column packing for high performance liquid chromatography, a detection method, and an eluate.

TABLE 1

| Fine Resin Particle | | Surfactant Type | Residual Amount of Surfactant (ppm) | Primary Particle Size (nm) | BET Specific Surface Area ($m^2/g$) |
|---|---|---|---|---|---|
| Invention | A | (1) | 60 | 400 | 20 |
| Invention | B | (1) | 500 | 300 | 88 |
| Invention | C | (1) | 2500 | 250 | 106 |
| Invention | D | (1) | 10000 | 80 | 120 |
| Comparison | e | (1) | 50 | 600 | 9 |
| Comparison | f | (1) | 10500 | 40 | 150 |
| Comparison | g | (2) | 2970 | 280 | 62 |
| Comparison | h | (3) | 2960 | 240 | 80 |
| Comparison | i | (4) | 2400 | 280 | 66 |

TABLE 1-continued

| Fine Resin Particle | | Surfactant Type | Residual Amount of Surfactant (ppm) | Primary Particle Size (nm) | BET Specific Surface Area ($m^2/g$) |
|---|---|---|---|---|---|
| Comparison | j | (5) | 2560 | 200 | 58 |

Sufactant (1)

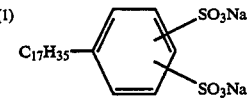

(2) $C_{12}H_{25}OSO_3Na$ (3) $C_{17}H_{35}COONa$ (4) $C_{17}H_{35}-\underset{\underset{O}{\|}}{C}-\underset{\underset{CH_3}{|}}{N}-C_2H_4-SO_3Na$ (5)

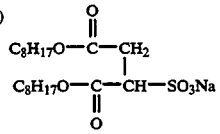

Example 1

| | |
|---|---|
| Core particles (ferrite particles of 80 μm average particle size) | 100 parts |
| Fine resin particle A | 2 parts |

The above carrier stock was introduced into a horizontal rotor blade mixer and stirred at a horizontal rotor blade peripheral speed of 8 m/sec for 10 minutes at 22° C. It was then heated to 90° C. and stirred for another 40 minutes to obtain a carrier of the invention.

Examples 2 to 4

Carriers of the invention were prepared in the same manner as in Example 1, except that fine resin particles B to D were used by turns in place of fine resin particle A.

<Comparative Example 1>

A comparative carrier was prepared in the same manner as in Example 1, except that fine resin particle e was used in place of resin fine particle A.

<Comparative Examples 2 to 6>

Comparative carriers were prepared in the same manner as in Example 1, except that fine resin particles f to j were used by turns in place of fine resin particle A.

These comparative carriers were so weak in adhesion of fine resin particles to core resin particles that a large number of fine resin particles were left uncombined.

<Evaluation>

The carriers of the invention and those for comparison prepared as above were evaluated for the following points:

(1) Evaluation of adhesion between Core Particles and Resin Coating Layers

In a 50-ml beaker were placed 4 g of carrier, the surfactant and water as dispersion medium. After stirring the mixture for 30 seconds in a supersonic homogenizer of 150 W output, the carrier was observed on a scanning electron microscope and rated as A when no peeling was found between core particles and resin coating layers and as B when peeling was found.

(2) Electrification Amount of Toner

Measurement was made by the usual blow-off method using a 350-mesh screen, under the conditions of blow pressure 0.2 kg/cm$^2$ and blow time of 6 seconds.

(3) Fog Density

Two-component developers were first prepared by mixing the respective carriers prepared in the above Examples and Comparative Examples with a toner for an Electrophotographic Copier U-bix 1017, at a mixing ratio to give a toner content of 5 wt %.

Using these two-component developers, an actual copying test was run on an Electrophotographic Copier U-bix 4045 made by Konica Corp. For each copied image, a density relative to the white density was determined using a Sakura Densitometer manufactured by Konic Corp. A fog can be visually perceived when its density exceeds 0.005.

(4) Scattering of Toner

After making 50,000 copies for each of the two-component developers prepared in (3) on the Electrophotographic Copier U-bix 4045, the inside of the copier was checked for contamination with the toner. Appearance of the contamination is shown by the following sign.

A: No contamination was observed after 50,000 copies

B: Contamination was observed after 10,000 copies

C: Contamination was observed after 2,000 copies

The results of the above evaluations are shown in Table 2.

TABLE 2

| | Type of Fine Resin Particle for Coating | Peeling of resin layer | Electrification Amount of Toner (μC/g) | Fog Density | Scattering of Toner |
|---|---|---|---|---|---|
| Example 1 | Fine resin particle A | A | 27.5 | 0.000 | A |
| Example 2 | Fine resin particle B | A | 25.4 | 0.000 | A |
| Example 3 | Fine resin particle C | A | 23.1 | 0.001 | A |
| Example 4 | Fine resin particle D | A | 23.5 | 0.001 | A |
| Comp. Example 1 | Fine resin particle e | B | 14.1 | 0.009 | B |
| Comp. Example 2 | Fine resin particle f | B | 12.5 | 0.010 | B |
| Comp. Example 3 | Fine resin particle g | B | 4.2 | 0.016 | C |
| Comp. Example 4 | Fine resin particle h | B | 5.0 | 0.016 | C |
| Comp. Example 5 | Fine resin particle i | B | 3.3 | 0.018 | C |
| Comp. Example 6 | Fine resin particle j | B | 2.1 | 0.019 | C |

It can be understood from the above results that the carriers of the invention are excellent in adhesion between core particles and resin coating layers and capable of providing a toner with an adequate frictional electricity. And, by use of a two-component developer comprising the carrier of the invention, fogging and scattering of toners can be prevented. Accordingly, it is clear that the carriers of the invention are far superior to the comparative carriers.

What is claimed is:

1. A carrier of developer for developing an electrostatic image comprising core particles each having a resin layer covering the surface of said core particle, wherein said resin layer is formed by a dry process, in which said core particles are stirred together with fine resin particles to form said resin layer without the use of solvent for the resin, and said fine resin particles comprise a homopolymer or a copolymer comprising a fluorinated acrylate repeating unit, which are formed by emulsified polymerization carried out in the presence of a surfactant comprising an alkylbenzene sulfonic compound, and the residual amount of the surfactant in said fine resin particles is within the range of from 60 ppm to 10,000 ppm.

2. The carrier of claim 1, wherein said fine resin particles have a primary particle size of 50 nm to 500 nm and a BET specific surface area of 10 m$^2$/g to 120 m$^2$/m.

3. The carrier of claim 1, wherein said core particles comprise a ferromagnetic material.

4. The carrier of claim 1, wherein said core particles have a weight average particle size of 20 μm to 200 μm.

5. The carrier of claim 1, wherein said fluorinate acrylate repeating unit is represented by the following formula 1:

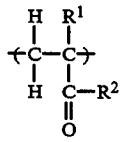

(1)

wherein $R^1$ is a hydrogen atom or a methyl group; $R^2$ is a residue formed by removing a hydrogen atom from the hydroxyl group of an alcohol compound having an alkyl group in which at least one hydrogen atom is substituted by a fluorine atom.

6. The carrier of claim 5, wherein the group represented by $R_2$ is $-O(CH_2)_nC_mF_{2m+1}$ or $-O(CH_2)_p(CF_2)_qH$, in which n and p are each an integer of 1 to 8, and m and q are each an integer of 1 to 19.

7. The carrier of claim 6, wherein the group represented by $R^2$ is $-OCH_2CF_3$, 13 $OCH_2(CF_2)_2H$ or $-OCH_2CF_2CF_3$.

8. The carrier of claim 1, wherein said copolymer comprises a fluorinated acrylate repeating unit in an amount of not less than 50 % by weight of said copolymer.

9. The carrier of claim 1, wherein said alkylbenzene sulfonic compound is a compound represented by the following Formula a or b;

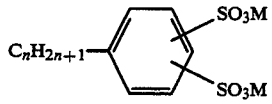

(a)

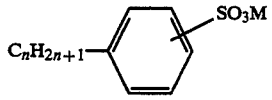

(b)

wherein M is an alkali metal atom or an alkali earth metal atom; n is an integer of 12 to 22.

10. The carrier of claim 1, wherein said core particle and said fine resin particle are stirred in a rotor blade mixer at a peripheral speed of stirring blade of 4 m/sec to 12 m/sec.

11. The carrier of claim 10, wherein the peripheral speed of stirring blade is 6 m/sec to 10 m/sec.

12. The carrier of claim 1, wherein the amount of said fine resin particles is 0.3% to 10% by weight of said core particles.

13. The carrier of claim 12, wherein the amount of said fine resin particles is 0.5% to 5% by weight of said core particles.

14. A method for producing a carrier of developer for developing an electrostatic image, which comprise core particles each having a resin layer covering the surface of said core particle, comprising the steps of stirring core particles and fine resin particles placed in a rotor blade mixer with no resin solvent at a peripheral speed of stirring blade of 4 m/sec to 12 m/sec to form a resin layer covering each of said core particles, wherein said fine resin particles comprise a homopolymer or a copolymer comprising a fluorinated acrylate repeating unit, which are formed by emulsified polymerization carried out in the presence of a surfactant comprising an alkylbenzene sulfonic compound, and the residual amount of the surfactant in said fine resin particles is within the range of from 60 ppm to 10,000 ppm.

* * * * *

UNITED STATES PATENT AND TRADEMARK OFFICE

CERTIFICATE OF CORRECTION

PATENT NO. : 5,376,488

DATED : December 27, 1994

INVENTOR(S) : Ken OHMURA et al

It is certified that error appears in the above-indentified patent and that said Letters Patent is hereby corrected as shown below:

Claim 7, Column 10, Line 35 change "13 $OCH_2(CF_2)_2H$" to --$OCH_2(CF_2)_2H$--.

Claim 14, Column 11, Line 2 change "comprise" to --comprises--.

Signed and Sealed this

Twenty-third Day of May, 1995

*Attest:*

BRUCE LEHMAN

*Attesting Officer*

*Commissioner of Patents and Trademarks*